US010230186B2

(12) United States Patent
Bogiel et al.

(10) Patent No.: US 10,230,186 B2
(45) Date of Patent: Mar. 12, 2019

(54) CONNECTOR WITH DUAL CARD SLOTS

(71) Applicant: Molex, LLC, Lisle, IL (US)

(72) Inventors: Steven B. Bogiel, Lisle, IL (US); Michael Rowlands, Naperville, IL (US)

(73) Assignee: Molex, LLC, Lisle, IL (US)

( * ) Notice: Subject to any disclaimer, the term of this patent is extended or adjusted under 35 U.S.C. 154(b) by 0 days.

(21) Appl. No.: 15/578,476

(22) PCT Filed: Jun. 1, 2016

(86) PCT No.: PCT/US2016/035283
§ 371 (c)(1),
(2) Date: Nov. 30, 2017

(87) PCT Pub. No.: WO2016/196641
PCT Pub. Date: Dec. 8, 2016

(65) Prior Publication Data

US 2018/0123271 A1 May 3, 2018

Related U.S. Application Data

(60) Provisional application No. 62/169,234, filed on Jun. 1, 2015.

(51) Int. Cl.
*H01R 12/73* (2011.01)
*H01R 13/6581* (2011.01)

(52) U.S. Cl.
CPC ..... *H01R 12/732* (2013.01); *H01R 13/6581* (2013.01)

(58) Field of Classification Search
CPC ..... H01R 25/006; H01R 13/24; H01R 27/00; H01R 12/724; H01R 12/732
See application file for complete search history.

(56) References Cited

U.S. PATENT DOCUMENTS 5,928,036 A * 7/1999 Thrush ..... H01R 12/716 439/631
7,044,748 B2 * 5/2006 Korsunsky ..... H05K 1/14 439/631
7,556,534 B1 * 7/2009 Ho ..... H01R 25/006 439/540.1
7,845,985 B2 * 12/2010 Brunker ..... H01R 13/504 439/631
7,985,082 B2 * 7/2011 Sun ..... G06K 19/07732 235/441
8,021,191 B2 * 9/2011 Long ..... H01R 13/514 439/626
8,075,343 B2 * 12/2011 Fu ..... H01R 12/732 439/328
8,142,207 B1 3/2012 Ljubijankic et al.
(Continued)

FOREIGN PATENT DOCUMENTS

JP 2006-236858 A 9/2006

*Primary Examiner* — Briggitte R Hammond
(74) *Attorney, Agent, or Firm* — Jeffrey K. Jacobs

(57) ABSTRACT

A connector is provided with a housing that includes a front face and a rear face, each face having a card slot. A row of terminals is provided and some of the terminals in the row have first contacts positioned in a card slot in the front face and second contacts positioned in a card slot in the second face. Other terminals in the row of terminals have contacts in the card slot in the front face and have tails configured to be mounted to a circuit board.

7 Claims, 15 Drawing Sheets

(56) References Cited

U.S. PATENT DOCUMENTS

| | | | | |
|---|---|---|---|---|
| 8,251,722 | B2 * | 8/2012 | Tsai | H01R 43/16 439/188 |
| 8,827,749 | B2 * | 9/2014 | Kim | G06K 7/0043 439/607.08 |
| 8,986,048 | B2 * | 3/2015 | Hendrickson | G01R 31/2862 439/631 |
| 2011/0269346 | A1 | 11/2011 | Casher et al. | |
| 2013/0273766 | A1 | 10/2013 | Lindkamp | |
| 2013/0309906 | A1 | 11/2013 | De Geest | |

* cited by examiner 50
136
134
136
134
136
134

CONNECTOR WITH DUAL CARD SLOTS

RELATED CASES

This application is a national stage of International Application No. PCT/US2016/035283, filed Jun. 1, 2016, which claims priority to United States Appln. Ser. No. 62/169,234, filed Jun. 1, 2015, which are incorporated herein by reference in their entireties.

FIELD OF THE DISCLOSURE

The present disclosure relates to the field of connectors, more specifically to connectors suitable for use in high data rate applications.

DESCRIPTION OF RELATED ART

Connectors suitable for use in high data rate applications are known. For example, connectors known as small form-factor pluggable (SFP) and quad small form-factor pluggable (QSFP) are currently available in configurations that support up to 25 Gbps data rates (so as to support 100 Gigabit Ethernet). While cables and chips can readily support such data rates using NRZ encoding (at least from a physics standpoint), the physical characteristics of a circuit board cause the circuit board to be problematic with respect to insertion loss, especially over distances of 20 cm or greater. More expensive circuit board materials can help reduce insertion loss but tend to be expensive. Consequentially, certain individuals would appreciate a connector that could support high data rates while providing an improvement to the issue of insertion loss at a system level.

SUMMARY

A connector is disclosed that includes a housing with a front face, a rear face and a mounting face, the housing supporting a plurality of terminals. The plurality of terminals can be positioned in a first row. A first set of terminals of the plurality of terminal in the first row have first contacts and second contacts. The first contacts are arranged in a first card slot provided on the front face. The second contacts are arranged in a second card slot in the rear face. A second set of terminals of the plurality of terminals in the first row have third contacts and tails. The third contacts are positioned in a first card slot and the tails are positioned on the mounting face for engagement with a supporting circuit board. Some of the plurality of terminals can further be positioned in a second row that includes a third set of terminals having fourth contacts and fifth contacts. The fourth contacts are positioned in the first card slot while the fifth contacts are positioned in a third card slot provided on the rear face. The second row can further include a fourth set of terminals, the fourth set of terminals having sixth contacts positioned in the first card slot and tails positioned on the mounting face. The first, third and fourth sets of terminals can include ground terminals that are commoned together. As can be appreciated, the connector allows for high frequency signals that can support high data rates (such as would be required to support 16 Gbps+) to pass through the connector without the need to pass through a supporting circuit board while allowing lower frequency signals to be routed to the circuit board.

BRIEF DESCRIPTION OF THE DRAWINGS

The organization and manner of the structure and operation of the disclosed embodiments, together with further objects and advantages thereof, may best be understood by reference to the following description, taken in connection with the accompanying drawings, which are not necessarily drawn to scale, wherein like reference numerals identify like elements in which:

FIG. 11 is a front perspective view of an upper frame with rows of signal and ground terminals and a row of low speed terminals mounted therein;

DETAILED DESCRIPTION OF THE ILLUSTRATED EMBODIMENT

Figure 1:
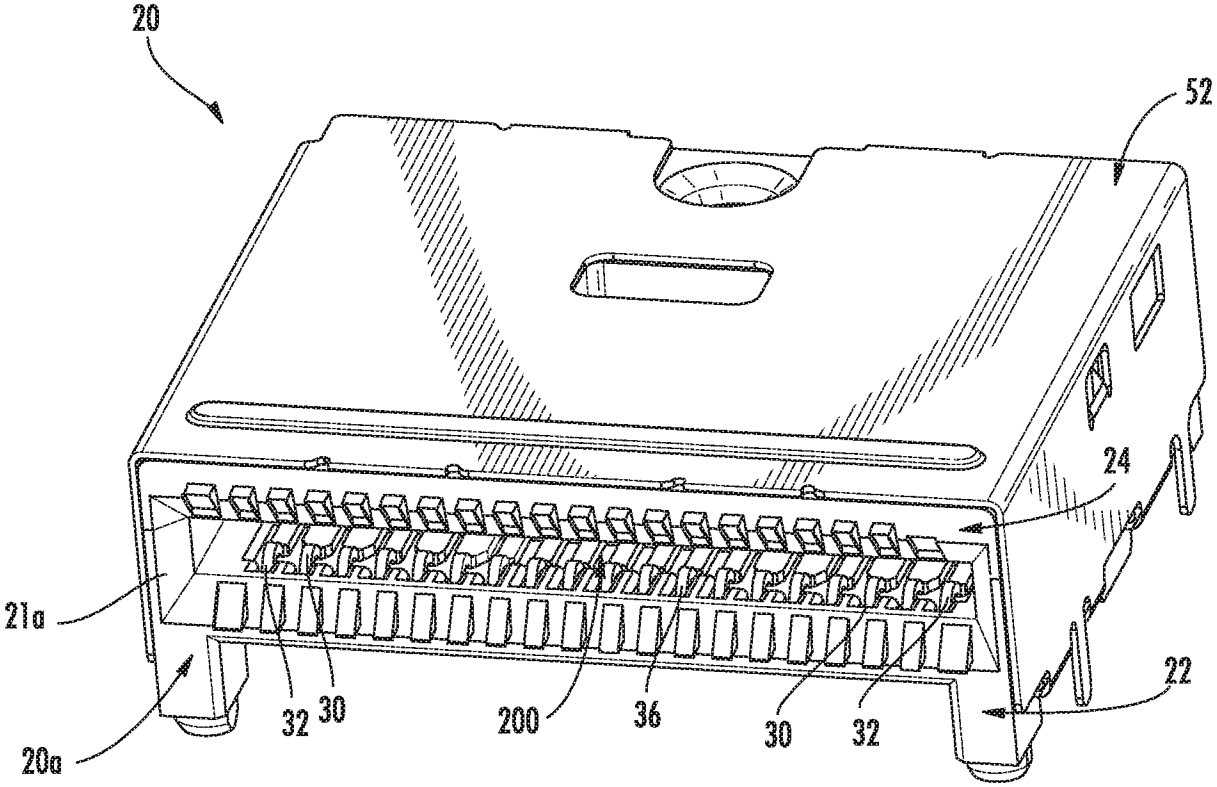
FIG. 1 is a front perspective view of an embodiment of a connector.

The detailed description that follows describes exemplary embodiments and is not intended to be limited to the expressly disclosed combination(s). Therefore, unless otherwise noted, features disclosed herein may be combined together to form additional combinations that were not otherwise shown for purposes of brevity.

Connectors commonly use one or more sets of terminal supported by a housing. Depending on the application, the housing may be mounted on a circuit board by itself (e.g., for internal applications) and when there is a desire to control EMI interfering with and being emitted from the connector it can be surrounded by a cage (e.g., for external applications). The disclosure provided herein is directed toward a connector that in certain embodiment is suitable for both internal and external applications and could be used with any appropriate cage design.

An embodiment of a connector 20 is suitable to be mounted on a circuit board (not shown). Directional terms such as front, rear, upper, lower and the like are used herein for ease in describing the connector 20. The use of these terms does not denote a required orientation of the connector 20 during assembly and during use.

The connector 20 includes a lower housing 22 and an upper housing 24 mated with the lower housing 22. The lower housing 22 and upper housing 24 define a first card slot 21*a* on a front face 20*a* and a second card slot 21*b* and a third card slot 21*c* on a rear face 20*b*. It should be noted that while benefits of the second and third card slots 21*b*, 21*c* can be appreciated from the discussion that follows it is possible in alternative embodiments to merge the second and third card slots so as to provide a single card slot on the rear face. It should also be noted that the upper and lower housings (as well as the upper and lower frames) could be split into additional pieces as desired.

A lower frame 26 is mounted on the lower housing 22. The lower frame 26 holds a first row 28 of signal and ground terminals 30, 32, a row 34 of low speed terminals 36, a second row 38 of signal and ground terminals 30, 32, and a grounding terminal 40. An upper frame 42 is mounted on the upper housing 24 and mates with the lower frame 26. The upper frame 42 holds a first row 44 of signal and ground terminals 30, 32, a row 46 of low speed terminals 47, and a second row 48 of signal and ground terminals 30, 32. A commoning shield 50 can be mounted between the lower and upper frames 26, 42 26, 42 and can be in electrical contact with the ground terminals 32 in the rows 28, 38, 44, 48 and with the grounding terminal 40. Each terminal 30, 32, 36, 40, 47, 50 is electrically conductive. The housings 22, 24 and the frames 26, 42 are non-conductive. As depicted, a conductive cover 52 surrounds a portion of the housings 22, 24.

As can be appreciated from the disclosure below, the commoning shield 50 helps shorten the electrical length of ground terminals. This helps increase the resonance frequency of those ground terminals to a range outside the frequencies of interest. The commoning shield also helps isolate the top terminals from the bottom terminals, which helps reduce crosstalk between the top and bottom terminals.

Figure 6:
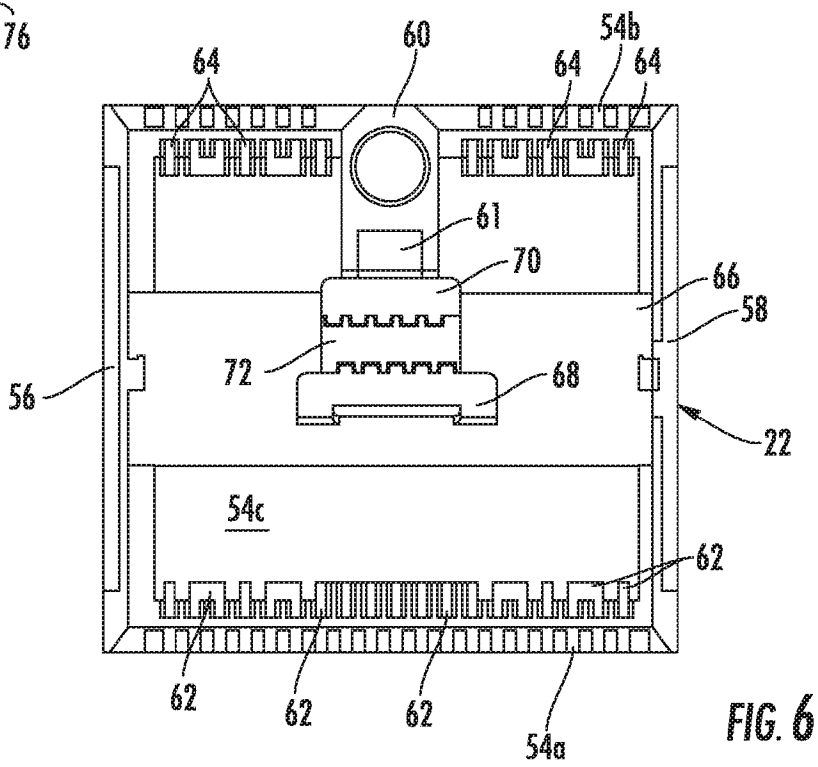
FIG. 6 is a top plan view of the lower housing of FIG. 5.
Figure 5:
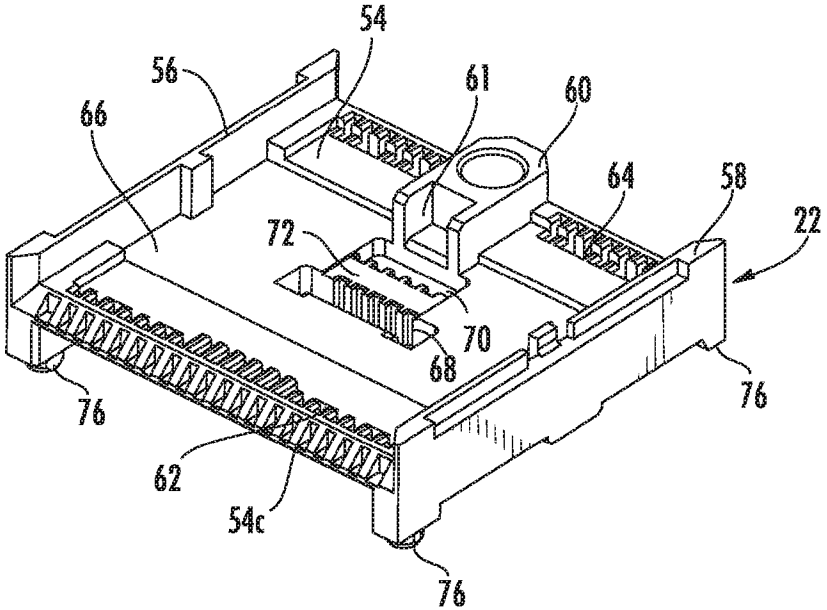
FIG. 5 is a front perspective view of a lower housing of the connector.

As shown in FIGS. 5 and 6, the lower housing 22 is formed from a base wall 54, side walls 56, 58 extending upwardly from a opposite sides of the base wall 54, and an intermediate wall 60 extending upwardly from a second end of the base wall 54. A recess 61 is provided in a forward end of the intermediate wall 60. The base wall 54 has a row of spaced apart through holes 62 proximate to a front edge 54*a* thereof, and a row of spaced apart through holes 64 proximate to a rear edge 54*b* thereof. At the rear edge 54*b*, the through holes 64 are provided on opposite sides of the intermediate wall 60. The front and rear edges 54*a*, 54*b* of the base wall 54 may be tapered and may have a plurality of recesses therein. A recess 66 is provided in the upper surface 54*c* of the base wall 54 at approximately the midpoint and extends between the side walls 56, 58. The recess 66 is forwardly of the intermediate wall 60. A pair of spaced passageways 68, 70 are provided through the recess 66 and extends from an upper surface of the base wall 54 to a lower surface of the base wall 54. The passageways 68, 70 are spaced apart from each other by a wall portion 72 of the base wall 54. An aperture may be provided through the intermediate wall 60. A plurality of mounting tails 74 extend downwardly from a lower surface of the base wall 54.

Figure 8:
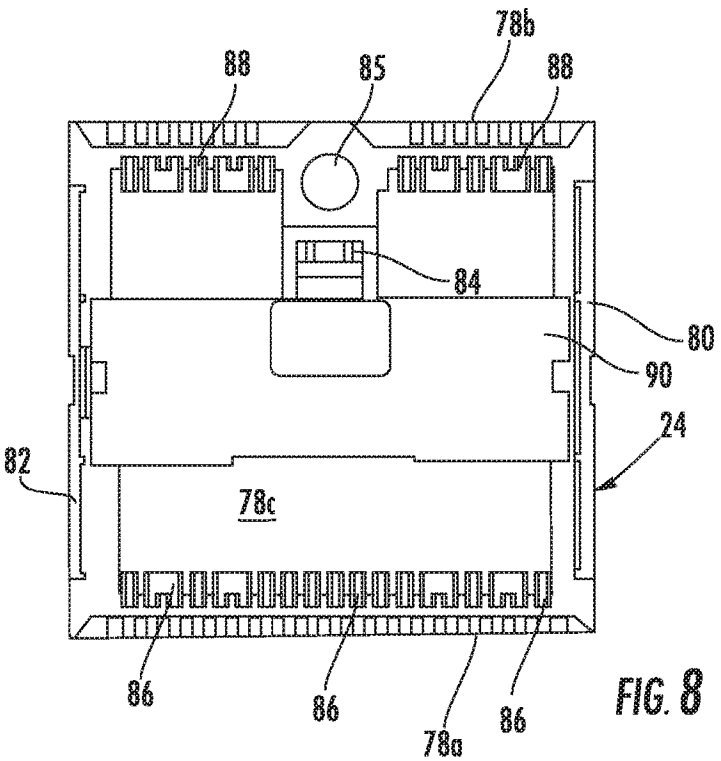
FIG. 8 is a bottom plan view of the upper housing of FIG. 7.
Figure 7:
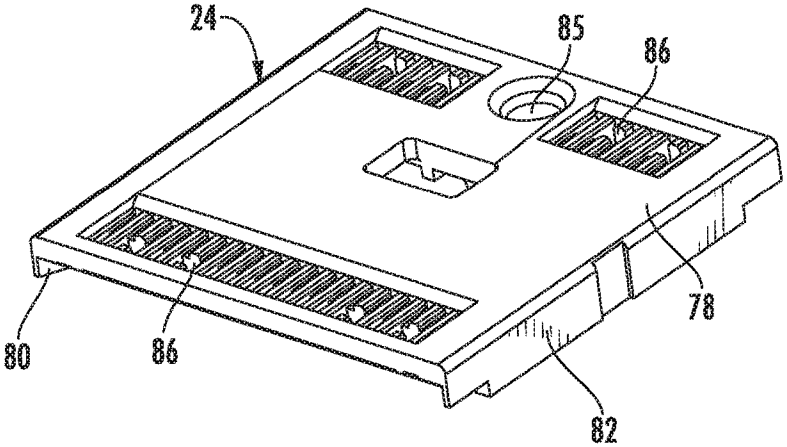
FIG. 7 is a front perspective view of an upper housing of the connector.

As shown in FIGS. 7 and 8, the upper housing 24 is formed from a base wall 78, side walls 80, 82 extending upwardly from a opposite sides of the base wall 78, and a protruding wall 84 extending downwardly from the lower surface of the base wall 78. An aperture 85 may be provided through the base wall 78 proximate to the rear edge 78*b*. The base wall 78 has a row of spaced apart through holes 86 proximate to a front edge 78*a* thereof, and a row of spaced apart through holes 88 proximate to the rear edge thereof. At the rear edge 78*b*, the through holes 88 are provided on opposite sides of the aperture 85. The front and rear edges 78*a*, 78*b* of the base wall 78 may be tapered and may have a plurality of recesses therein. A recess 90 is provided in the lower surface 78*c* of the base wall 78 at approximately the midpoint and extends between the side walls 80, 82. The recess 90 is forwardly of the aperture 85. An aperture may be provided through the recess 90.

The lower and upper housings 22, 24 mate together such that the ends of the side walls 80, 56 abut against each other, the ends of the side walls 82, 58 abut against each other, and the recesses 66, 90 are vertically aligned. The wall 84 seats within recess 61.

Figure 9:
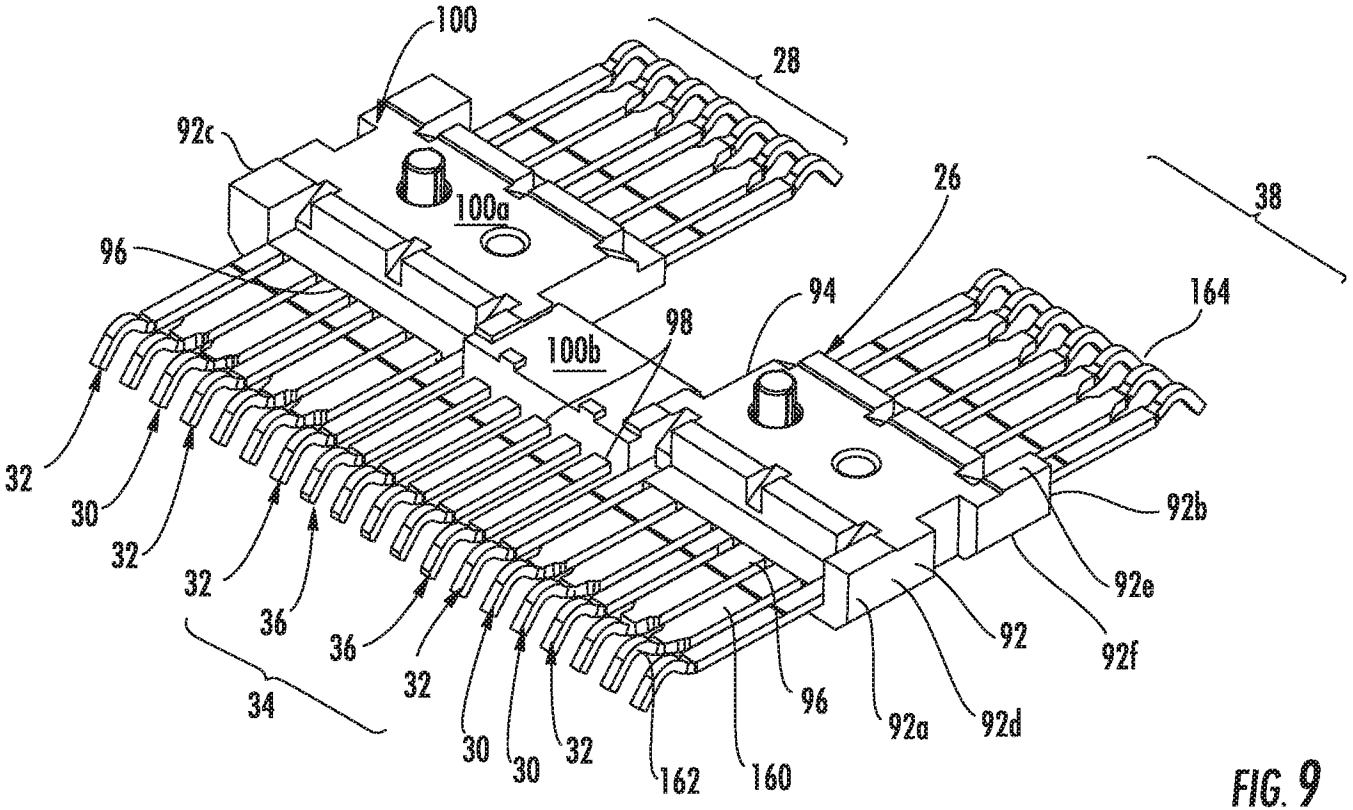
FIG. 9 is a front perspective view of a lower frame with rows of signal and ground terminals and a row of low speed terminals mounted therein.
Figure 10:
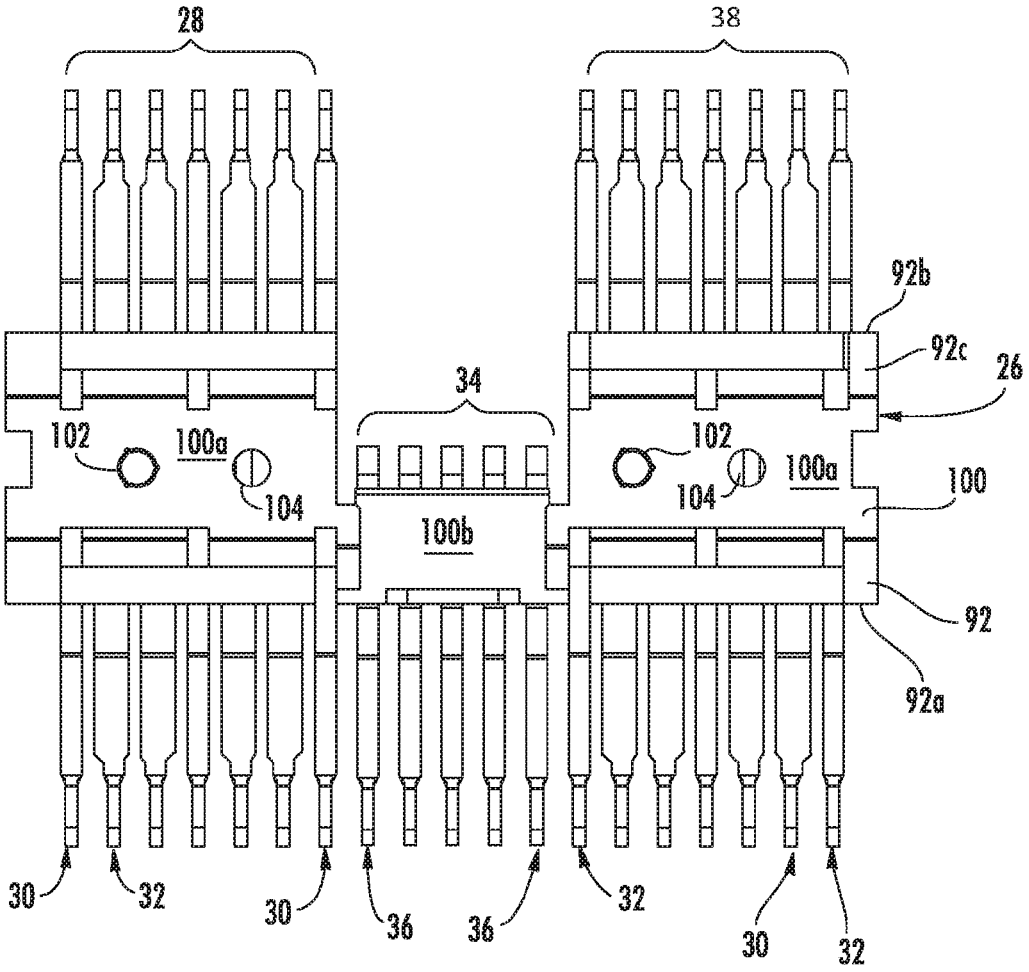
FIG. 10 is a top plan view of the lower frame, the rows of signal and ground terminals and the row of low speed terminals.
Figure 77:
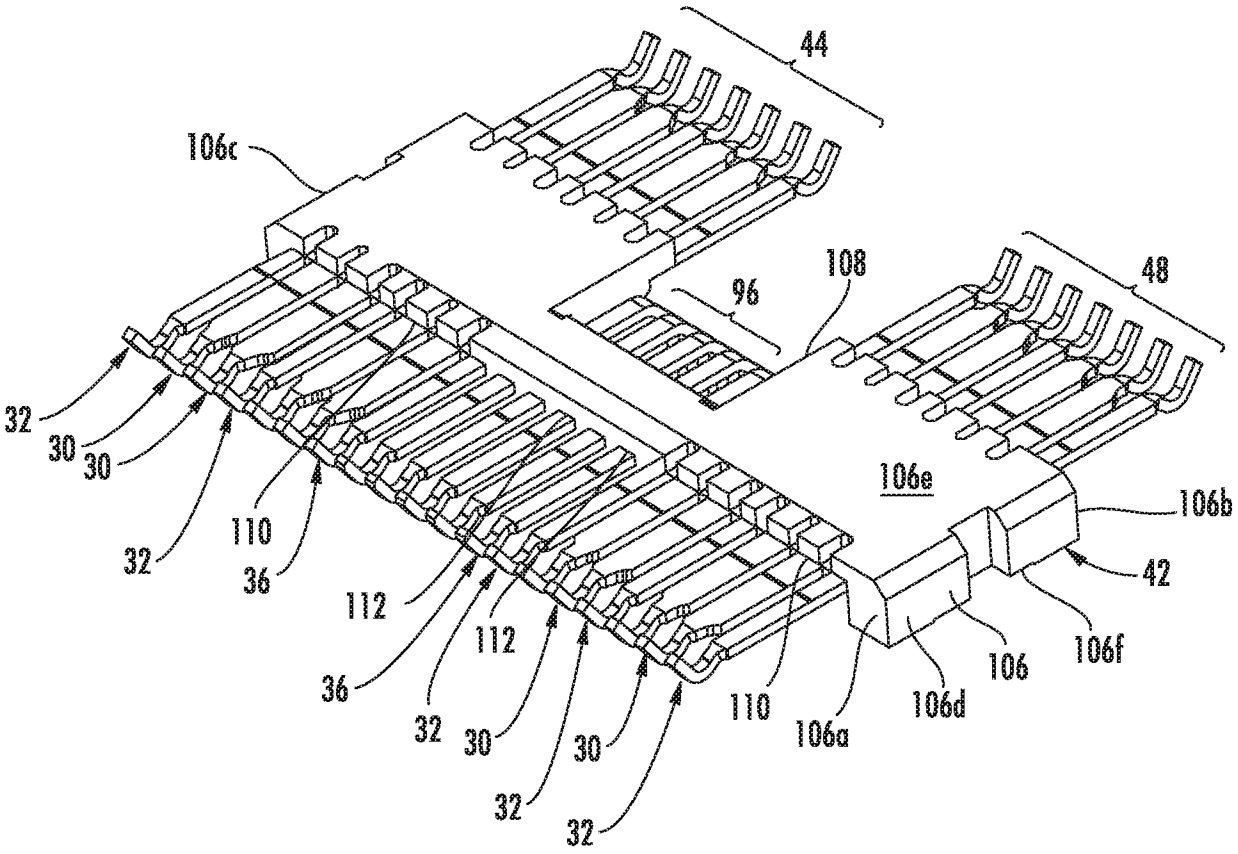

As shown in FIGS. 9 and 10, the lower frame 26 is formed of a wall 92 having a front end 92*a*, a rear end 92*b*, opposite side edges 92*c*, 92*d*, a top surface 92*e* and a bottom surface 92*f*. A cutout 94 is provided in the wall 92 and extends a predetermined distance forwardly from the rear end 92*b* toward the front end 92*a*. A plurality of spaced apart passageways 96 are provided through the wall 92 on opposite sides of the cutout 94. Each passageway 96 extends from the front end 92*a* to the rear end 92*b* of the wall 92. A plurality of spaced apart passageways 98 are provided through the wall 92 and extend from the front end 92*a* to the cutout 94. A recess 100 is provided in the upper surface 92*e* and extends between the opposite side edges 92*c*, 92*d*. The recess 100 has side portions 100*a* with a central portion 100*b* therebetween. The central portion 100*b* is proximate to the cutout 94 and has a depth which is greater than the depths of the side portions 100*a*. A pin 102 extends upwardly from each side portion 100*a*, and a blind bore 104 is provided in each side portion 100*a*.

Figure 12:
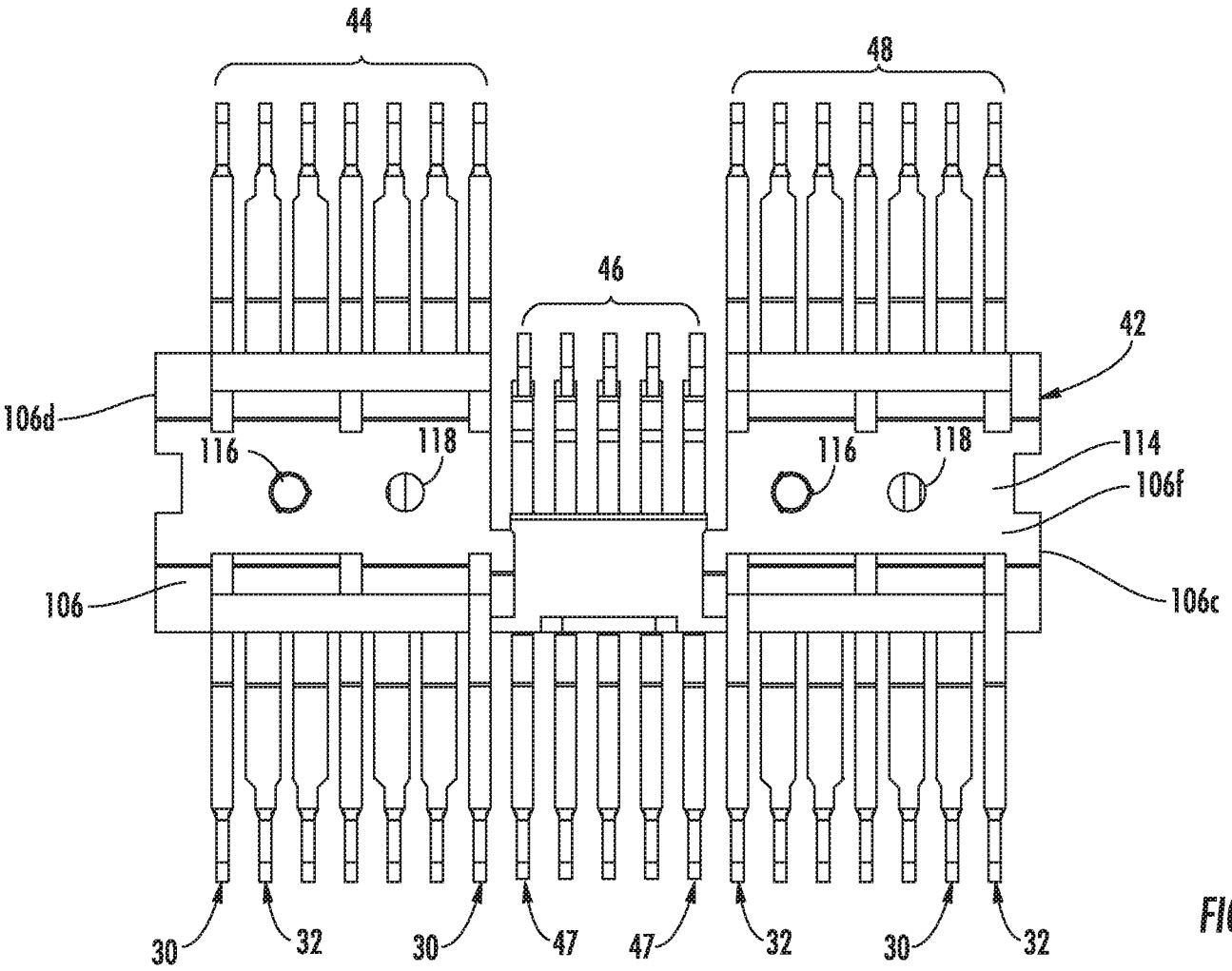
FIG. 12 is a top plan view of the upper frame, the rows of signal and ground terminals and the row of low speed terminals.

As shown in FIGS. 11 and 12, the upper frame 42 is formed of a wall 106 having a front end 106*a*, a rear end 106*b*, opposite side edges 106*c*, 106*d*, a top surface 106*e* and a bottom surface 106*f*. A cutout 108 is provided in the wall 106 and extends a predetermined distance forwardly from the rear end 106*b* toward the front end 106*a*. A plurality of spaced apart passageways 110 are provided through the wall 106 on opposite sides of the cutout 108. Each passageway 110 extends from the front end 106*a* to the rear end 106*b* of the wall 106. A plurality of spaced apart passageways 112 are provided through the wall 106 and extend from the front end 106*a* to the cutout 108. A recess 114 is provided in the lower surface 106*f* and extends between the opposite sides 106*c*, 106*d*. Pins 116 extend downwardly from the recess 114 and blind bores 116 are provided in the recess 114.

Figure 14:
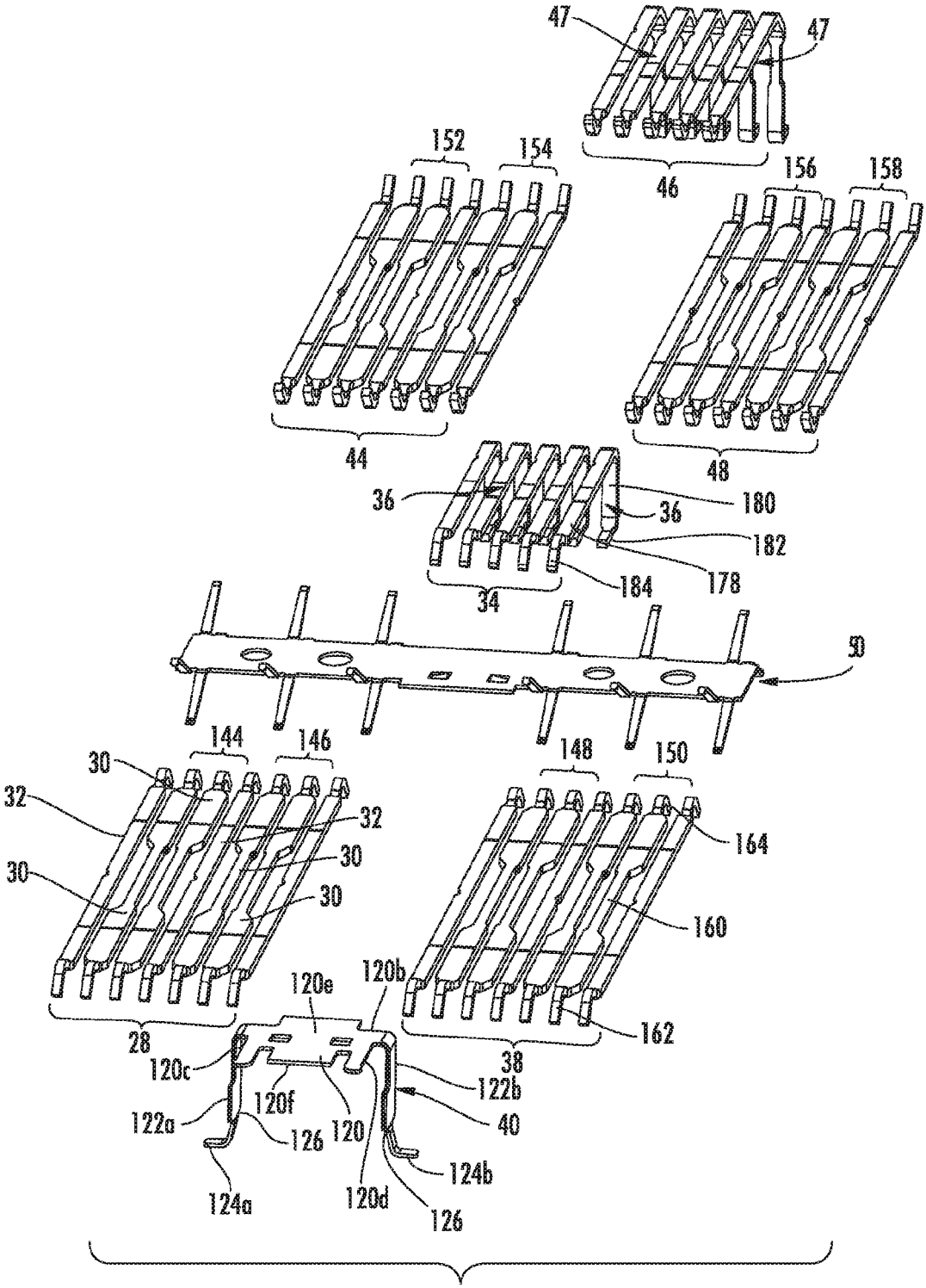
FIG. 14 is a front exploded perspective view of the terminals of the connector.

As shown in FIG. 14, the grounding terminal 40 is formed from a planar body 120, a pair of legs 122*a*, 122*b* extending from the body 120 and a tail 124*a*, 124*b* extending from each leg 122*a*, 122*b*. The legs 122*a*, 122*b* extend from opposite side edges 120*c*, 120*d* of the body 120 proximate to a rear end 120*b* of the body 120. The legs 122*a*, 122*b* have an upper portion and a lower portion; the upper portion having a width which is less than the width of the lower portion such that a shoulder 126 is formed in each leg 122*a*, 122*b*. The tail 124*a*, 124*b* extends outwardly from the respective leg 122*a*, 122*b*, such that the tails 124*a*, 124*b* extend outwardly from the body 120. A lower surface 120*f* of the body 120 seats within the central portion 100*b* of the recess 100 in the lower frame 26 and the body 120 extends rearwardly into the cutout 94. The legs 122*a*, 122*b* extend downwardly into the cutout 94 and the shoulders 126 engages with the lower surface 92*f* of the lower frame 26. The tails 124*a*, 124*b* extend towards the side edges 92*c*, 92*d* of the lower frame 26.

Figure 15:
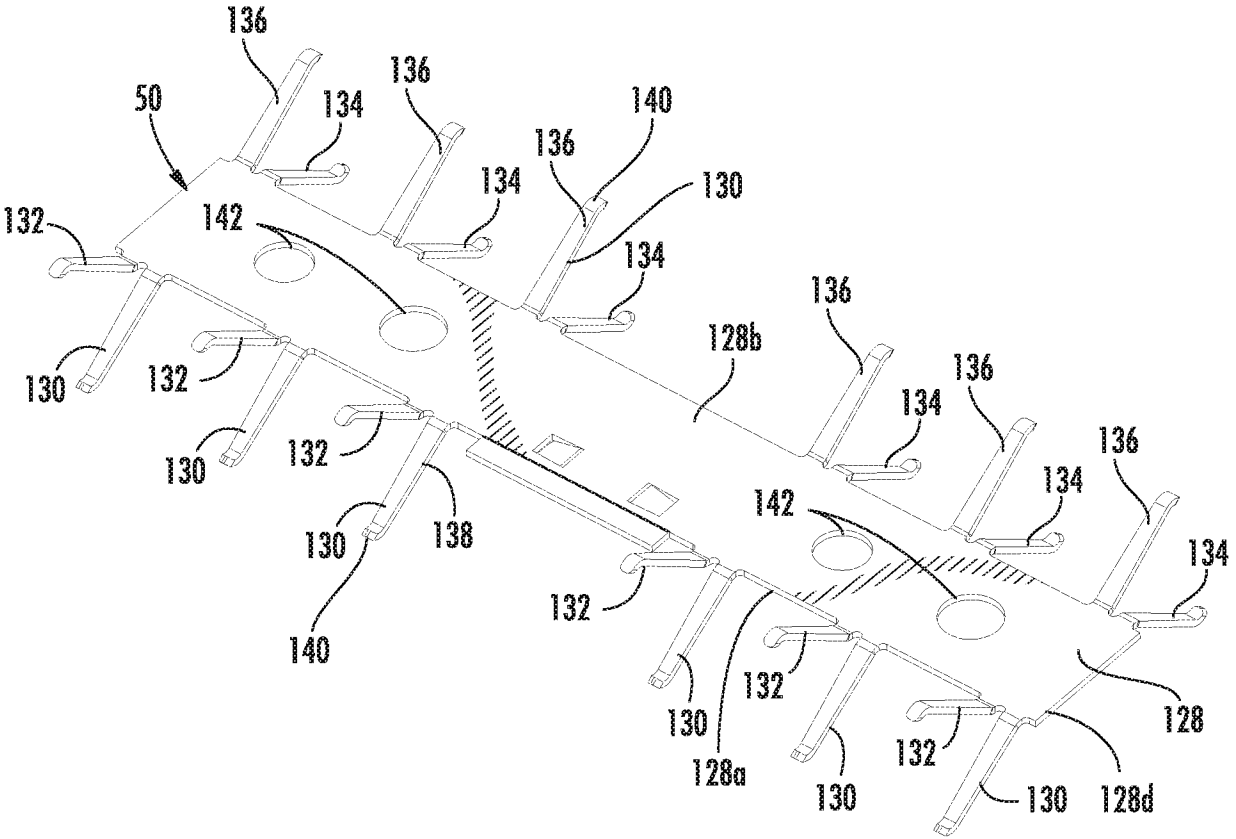
FIG. 15 is a perspective view of the commoning ground terminal.

As shown in FIG. 15, the commoning shield 50 is formed from a base wall 128 having a first set of spaced apart arms 130 extending downwardly at an angle from a front edge 128*a* of the base wall 128, a second set of spaced apart arms 132 extending upwardly at an angle from the front edge 128*a* of the base wall 128, a first set of spaced apart arms 134 extending downwardly at an angle from a rear edge 128*b* of the base wall 128, a second set of spaced apart arms 136 extending upwardly at an angle from the rear edge 128*b* of the base wall 128. Each arm 130, 132, 134, 136 includes a body 138 and a curved contact 140. A plurality of spaced apart holes 142 are provided through the base wall 128.

The base wall 128 of the commoning shield 50 seats within the side portions 100*a* of the recess 100 provided in the lower frame 26 and in the recess 114 provided in the upper frame 42. The lower surface 128*d* of the commoning shield 50 engages against an upper surface 120*e* of the body 120 of the grounding terminal 40. The holes 142 in the commoning shield 50 align with the pins 102, 116 and blind bores 104, 118 in the frames 26, 42, such that the pins 102, 116 extend through the holes 142. The frames 26, 42 mate together with the commoning shield 50 and the grounding terminal 40 sandwiched therebetween. The pins 102, 116 engage within the blind bores 104, 118 to secure the frames 26, 42 together. Since the arms 130, 134 angle downwardly relative to the body 128 of the commoning shield 50, the contacts 140 on the arms 130, 134 are spaced below the lower surface 92*f* of the lower frame 26 when the arms 130, 134 are in an unflexed condition. Likewise, since the arms 132, 136 angle upwardly relative to the body 128 of the commoning shield 50, the contacts 140 on the arms 132, 136 are spaced above the upper surface 106*e* of the upper frame 42 when the arms 132, 136 are in an unflexed condition. The frames 26, 42 may have cutouts in the front and rear ends 92*a*, 92*b*, 106*a*, 106*b* to accommodate the arms 130, 132, 134, 136.

Figure 16:
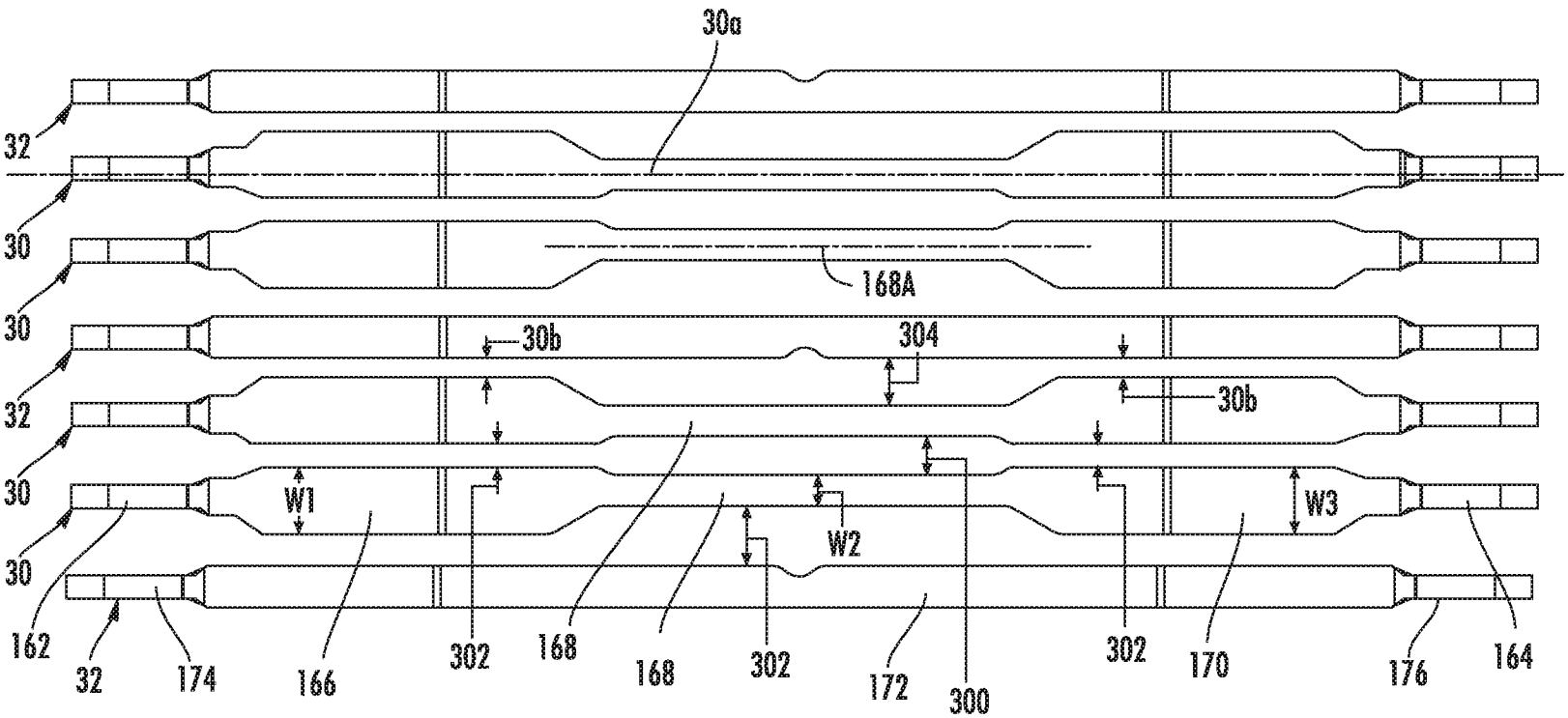
FIG. 16 is a side elevation view of the low speed terminals.

As shown in FIG. 16, each signal terminal 30 is formed from a planar body 160 having a curved contact 162 at a front end of the body 160 and a curved contact 164 at a rear end of the body 160. In the lower rows 28, 38, the contacts 162, 164 curve upwardly and then downwardly. In the upper rows 44, 48, the contacts 162, 164 curve downwardly and then upwardly. In each signal terminal 30, the body 160 has a front portion 166 having a first width W1, a central portion 168 extending from the front portion 166 which has a second width W2, and a rear portion 170 extending from the central portion 168 which has a third width W3. The first and third widths W1, W3 may be the same. The width W2 of the central portion 168 is less than the first and third widths W1, W3 of the front and rear portions 166, 170. The centerline 168*a* of the central portion 168 is offset from a centerline 30*a* of the signal terminal 30.

With further reference to FIG. 16, each ground terminal 32 is formed from a planar body 172 having a curved contact 174 at a front end of the body 172 and a curved contact 176 at a rear end of the body 172. In the lower rows 28, 38, the contacts 174, 176 curve upwardly and then downwardly. In the upper rows 44, 48, the contacts 174, 176 curve downwardly and then upwardly. The body 172 has a generally consistent width along its length. The body 172 may have a cutout at approximately its midpoint which aligns with the central portions 168 of the signal terminals 30.

As shown in FIG. 9, the first row 28 of signal and ground terminals 30, 32 extend though the passageways 96 of the lower frame 26 formed on one side of the cutout 94. The second row 38 of signal and ground terminals 30, 32 extend though the passageways 96 of the lower frame 26 formed on the other side of the cutout 94. The central portions 168 of the signal terminals 30 seat within the passageways 96 of the lower frame 26 and are surrounded by the lower frame 26. Signal terminals 30 are positioned within the passageways 96, so as to provide signal pairs 144, 146, 148, 150, with each signal pair 144, 146, 148, 150 being surrounded on both sides by ground terminals 32. The contacts 162, 174 are aligned with each other; the contacts 164, 176 are aligned with each when mounted in the lower frame 26.

As shown in FIG. 9, the first row 44 of signal and ground terminals 30, 32 extend though the passageways 110 of the upper frame 42 formed on one side of the cutout 108. The second row 48 of signal and ground terminals 30, 32 extend though the passageways 110 of the upper frame 42 formed on the other side of the cutout 108. The central portions 168 of the signal terminals 30 seat within the passageways 110 of the upper frame 42 and are surrounded by the upper frame 42. Signal terminals 30 are positioned within the passageways 110, so as to provide signal pairs 152, 154, 156, 158, with each signal pair 152, 154, 156, 158 being surrounded on both sides by ground terminals 32. The contacts 162, 174 are aligned with each other; the contacts 164, 176 are aligned with each when mounted in the upper frame 42.

In adjacent pairs 144, 146, 148, 150, 152, 154, 156, 158, the central portions 168 are offset to opposite sides from their respective centerlines 168*a*. As such, the central portions 168 are close to each other in adjacent pairs 144, 146, 148, 150, 152, 154, 156, 158.

Figure 4:
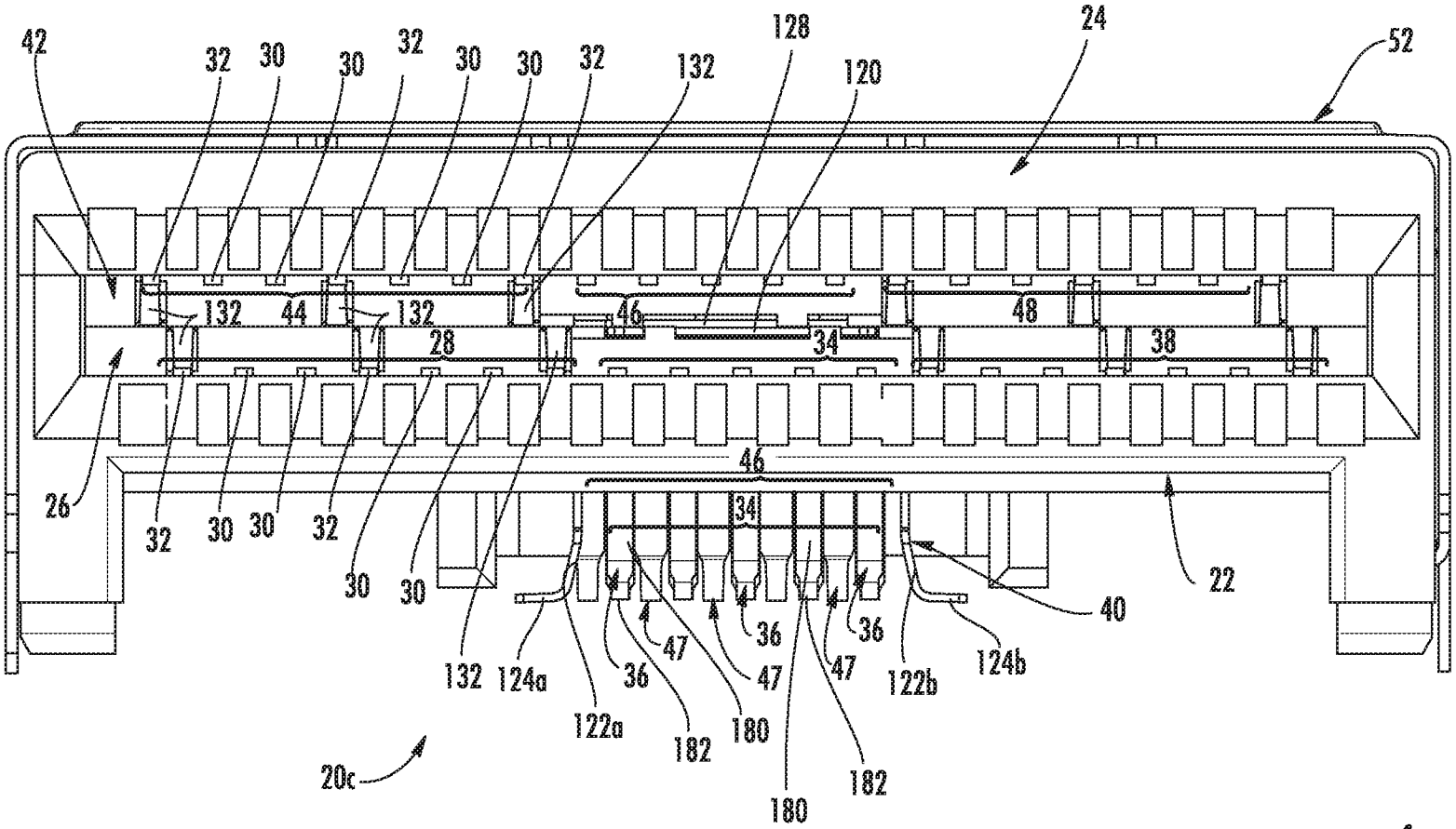
FIG. 4 is a front elevation view of the connector.

As shown in FIG. 4, the terminals 30, 32 within the first row 28 in the lower frame 26 are vertically offset from the terminals within the first row 44 in the upper frame 42, such that the pitch between these rows 28, 44 of terminals 30, 32 is offset. The terminals 30, 32 within the second row 38 in the lower frame 26 are vertically offset from the terminals 30, 32 within the second row 48 in the upper frame 42, such that the pitch between these rows 38, 48 of terminals 30, 32 is offset. The low speed terminals 36 within the row 34 in the lower frame 26 are vertically offset from the low speed terminals 47 within the row 46 in the upper frame 42, such that the pitch between these rows 34, 46 of terminals 30, 32 is offset.

Figure 13:
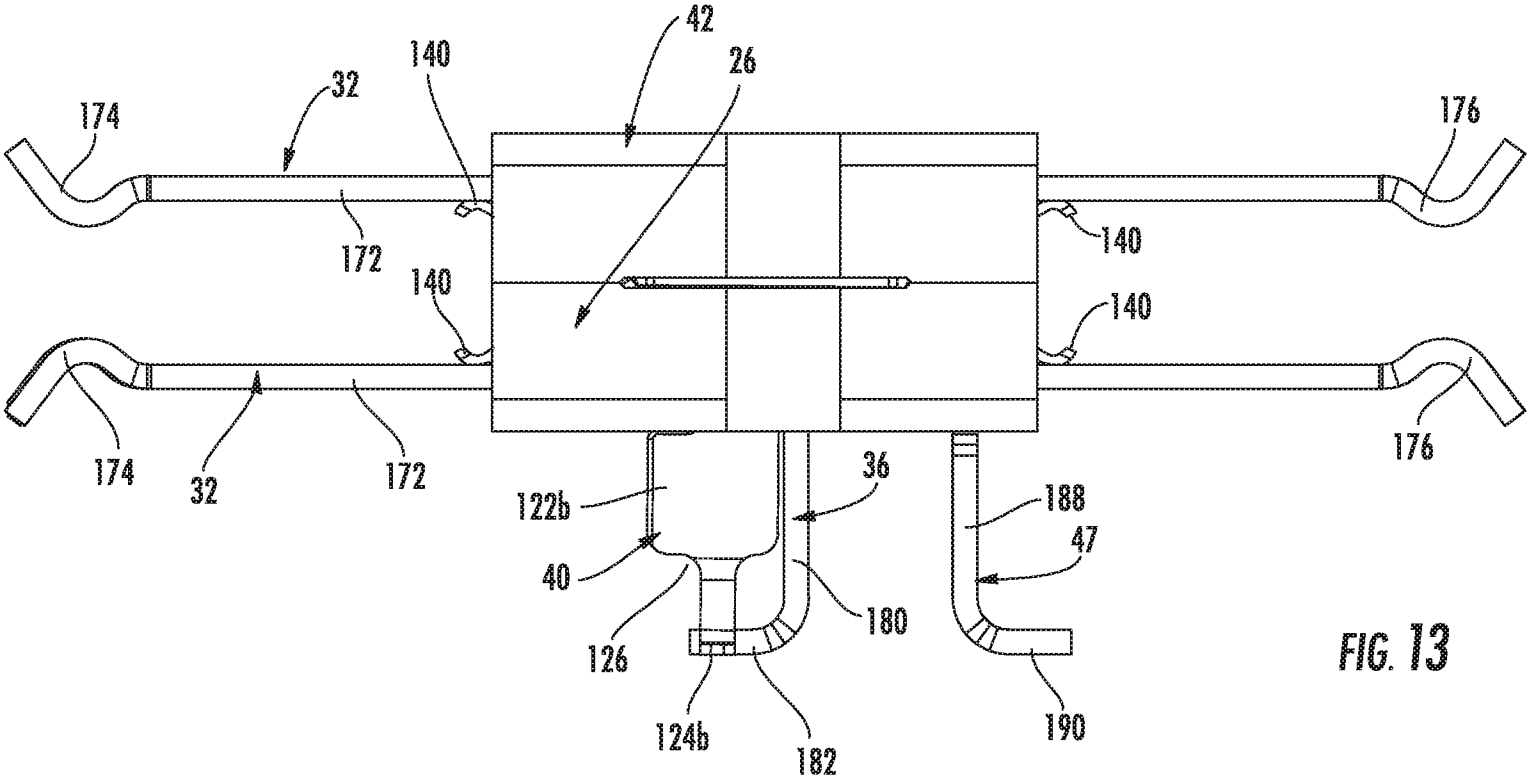
FIG. 13 is a side elevation view of the lower and upper frames, having the rows of signal and ground terminals and the rows of low speed terminals mounted therein, along with a commoning ground terminal and a grounding terminal mounted therein.

The contacts 140 of the commoning shield 50 engage with an underside of the body 172 of the respective ground terminal 32 in the first and second rows 28, 38 mounted in the lower frame 26, see FIG. 13. The contacts 140 of the commoning shield 50 engage with an underside of the body 138 of the respective ground terminal 32 in the first and second rows 44, 48 mounted in the upper frame 42. During this engagement, the arms 138 of the commoning shield 50 may flex to ensure a reliable contact with the ground terminals 32.

Figure 17:
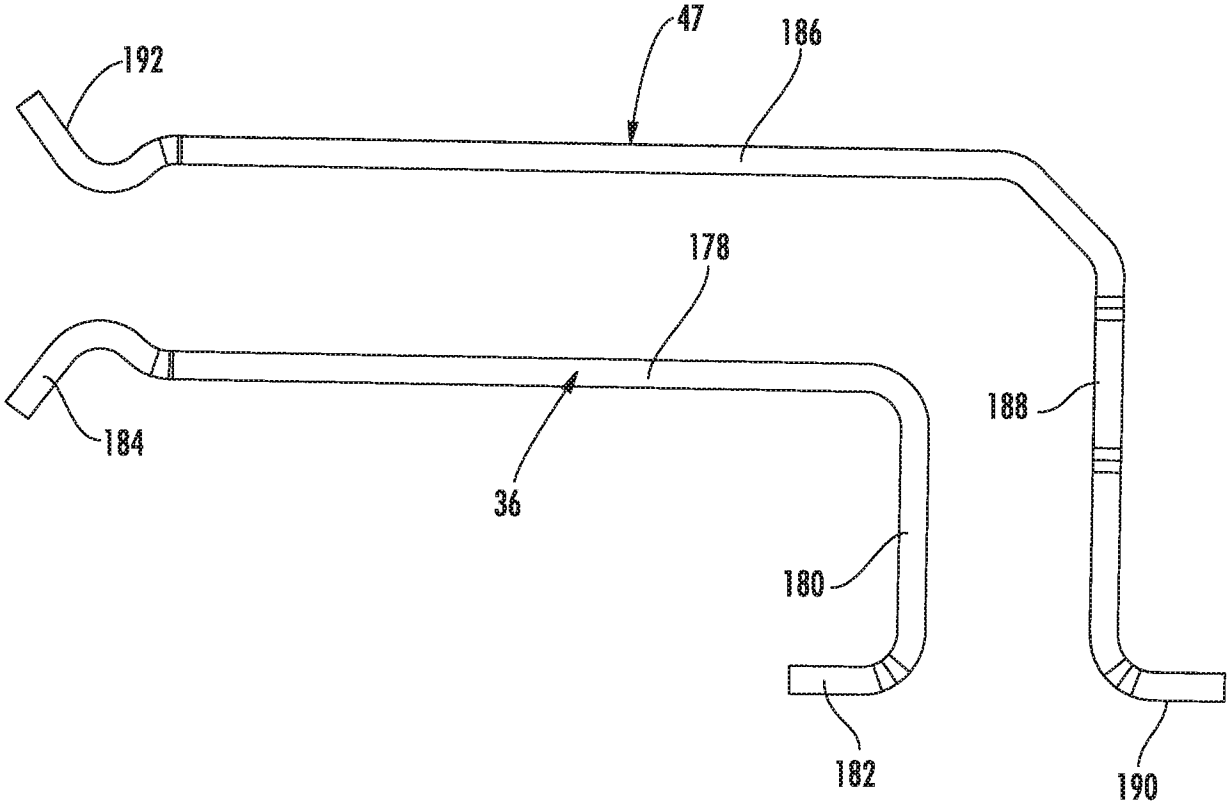
FIG. 17 is another view of the low speed terminals.

The row 34 of low speed terminals 36 is formed from a plurality of like terminals. As shown in FIG. 17, each low speed terminal 36 has an upper leg portion 178, a lower leg portion 180 which extends perpendicularly from a rear end of the upper leg portion 178, a tail 182 extending perpendicularly and forwardly from the lower leg portion 180 and which is parallel to the upper leg portion 178, and a contact 184 extending from a front end of the upper leg portion 178. The contact 184 curves upwardly and then downwardly. As shown in FIG. 9, for each low speed terminal 36, the upper leg portion 178 mounts in a passageway 98 in the lower frame 26, the lower leg portion 180 extends downwardly through the cutout 94, and the tail 182 extends forwardly. As shown in FIG. 4, the legs 122*a*,122*b* of the grounding terminal 40 are on opposite sides of the row 34 of low speed terminals 36 such that the row 34 is between the legs 122*a*,122*b*. As shown in FIG. 13, the legs 122*a*,122*b* of the grounding terminal 40 are proximate to the lower leg portions 180 and tails 182 of the outermost low speed terminals 36 in the row 34. The tails 124*a*, 124*b* on the grounding terminal 40 extend outwardly from the row 34 of low speed terminals 36. The contacts 184 of the low speed terminals 36 align with the contacts 174 on the signal and ground terminals 30, 32 of the first and second rows 28, 38 mounted in the lower frame 26. As can be appreciated, therefore the first row 44 includes a set of terminals that have contacts on a front end and on a rear end The row 46 of low speed terminals 47 is formed from a plurality of like terminals. As shown in FIG. 17, each low speed terminal 47 has an upper leg portion 186, a lower leg portion 188 which extends perpendicularly from a rear end of the upper leg portion 186, a tail 190 extending perpendicularly and rearwardly from the lower leg portion 188 and which is parallel to the upper leg portion 186, and a contact 192 extending from a front end of the upper leg portion 186. The contact 192 curves downwardly and then upwardly. As shown in FIG. 11, for each low speed terminal 47, the upper leg portion 186 mounts in a passageway 112 in the upper frame 42, the lower leg portion 188 extends downwardly through the cutout 108, and the tail 190 extends rearwardly. As shown in FIG. 4, the legs 122*a*,122*b* of the grounding terminal 40 are on opposite sides of the row 46 of low speed terminals 47. The contacts 192 of the low speed terminals 47 align with the contacts 174 on the signal and ground terminals 30, 32 of the first and second rows 44, 48 mounted in the upper frame 42.

The lower frame 26 seats within the recess 66 in the lower housing 22. The signal and ground terminals 30, 32 extend forwardly and rearwardly relative to the lower housing 22 and parallel to the circuit board. The portions of the bodies 166, 172 of the terminals 30, 32 which are not seated within the lower frame 26 engage against the upper surface 54*c* of the lower housing 22. The contacts 162, 174 of the terminals 30, 32 seat within the through holes 62; the contacts 164, 176 of the terminals 30, 32 seat within the through holes 64. The legs 122*a*, 122*b* of the grounding terminal 40 and the lower leg portions 180 of the low speed terminals 36 extend through the forward passageway 68 in the base wall 54 of the lower housing 22.

The upper frame 42 seats within the recess 90 in the upper housing 24 and the terminals 30, 32 extend forwardly and rearwardly relative to the upper housing 24 and parallel to the circuit board. The portions of the bodies 170, 172 of the terminals 30, 32 which are not seated within the upper frame 42 engage against the lower surface 78*c* of the upper housing 24. The contacts 162, 174 of the terminals 30, 32 seat within the through holes 86; the contacts 164, 176 of the terminals 30, 32 seat within the through holes 88. The lower leg portions 188 of the low speed terminals 47 extend through the rearward passageway 70 in the base wall 54 of the lower housing 22.

As shown in FIG. 13, the tails 182, 190 of the low speed terminals 36, 47 extend in opposite directions, that is the tails 182 extend forwardly and the tails 190 extend rearwardly. A bottom surface of each tail 124*a*, 124*b*, 182, 190 falls within the same plane. The tails 124*a*, 124*b*, 182, 190 engage with the circuit board in known manner.

Figure 2:
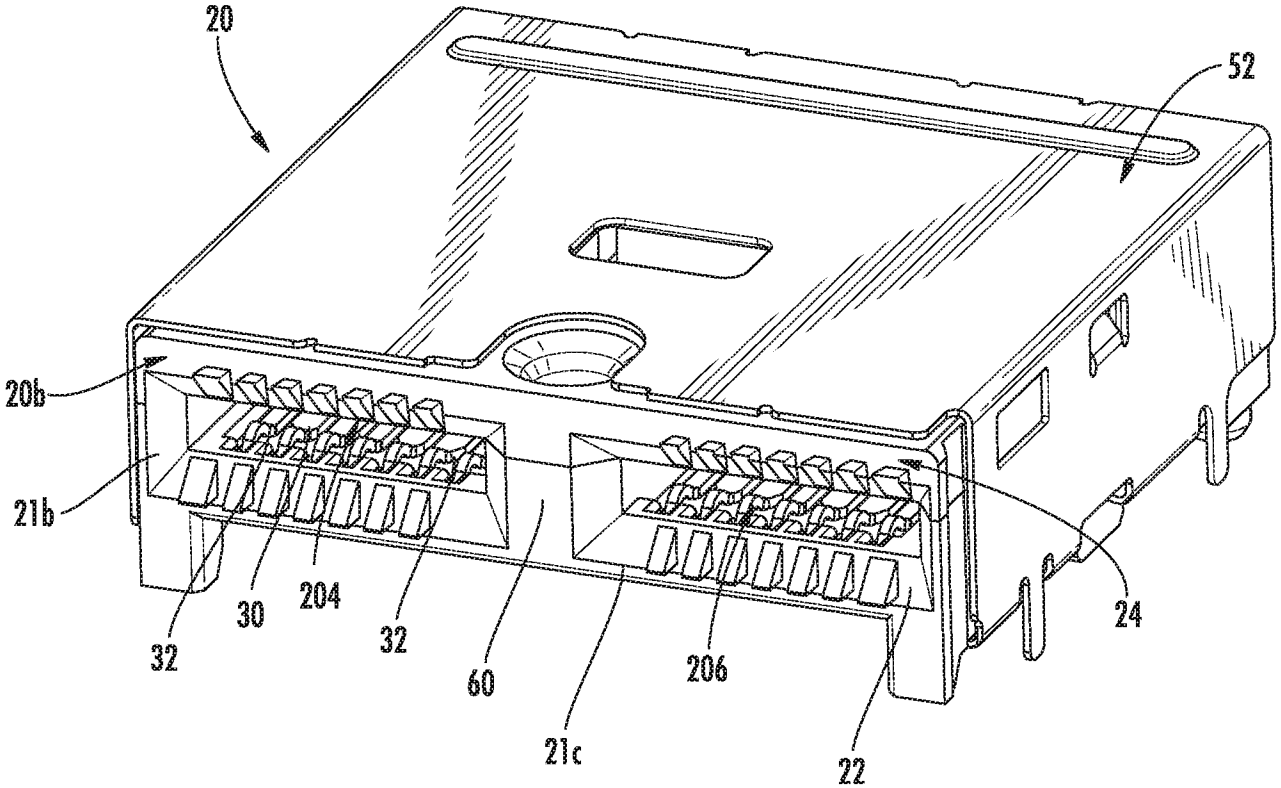
FIG. 2 is a rear perspective view of the connector.
Figure 3:
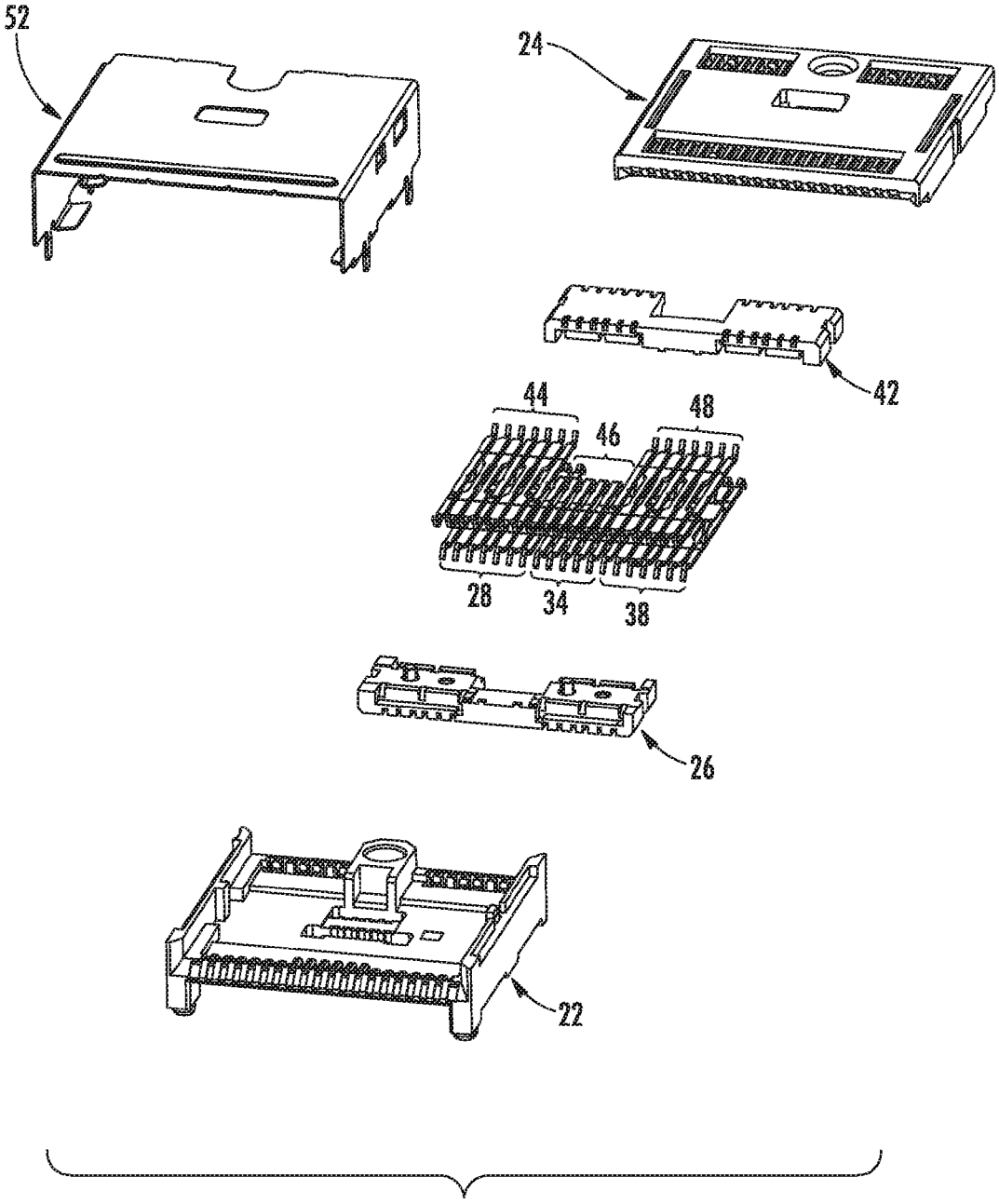
FIG. 3 is an exploded front perspective view of the connector.

As a result of the construction of the connector 20 and as shown in FIGS. 1 and 2, a front slot 200 is formed and a pair of rear slots 202, 204 are formed. A connector (not shown) is insertable into the front slot 200 to engage with the rows 28, 34, 38, 44, 46, 48 of terminals 30, 32, 36, 47 at the front end of the connector 20. A connector (not shown) is insertable into the rear slots 202, 204 to engage with the rows 28, 38, 44, 48 of terminals 30, 32. The connector 20 is grounded to the circuit board via the ground path formed by ground terminals 32, commoning shield 50 and grounding terminal 40.

While the commoning shield 50 and the grounding terminal 40 are shown and described as two separate components herein, the commoning shield 50 and grounding terminal 40 can be integrally formed as a single terminal.

While eight signal pairs 144, 146, 148, 150, 152, 154, 156, 158 and their associated ground terminals 32 are shown, this is illustrative only and more or less than eight signal pairs and associated ground terminals may be provided. While five low speed terminals 36, 47 are shown in each row 34, 36, more or less than five low speed terminals may be provided.

Regardless of the number of high and low speed terminals, the basic construction allows a connector 20 that has a mounting face 20*c* that mounts on a circuit board to have a set of terminals in a top row of terminals (which could be the terminals in row 44) to have contacts in the first card slot 21*a* on the front face 20*a* of the connector 20 and to also have contacts in the second card slot 21*b* on the rear face 20*b* while allowing another set of terminals in the top row (which could be the terminals in row 46) to have contacts in the first card slot 21*a* while having tails for terminating to the circuit board. The tails 190 can be positioned between the contacts in the first and second card slots 21*a*, 21*b* on the mounting face so that when viewed from a side, the terminals provide a T-shaped structure. A bottom row of terminals can be similarly configured with a set of terminals in the bottom row having contacts in the first card slot 21*a* and second card slot 21*b* while another set of terminals in the bottom row having contacts in the first card slot 21*a* and having tails for terminating to the circuit board (see, e.g., FIG. 13).

As discussed herein, signal terminals 30 are positioned so as to provide signal pairs 144, 146, 148, 150, 152, 154, 156, 158, which signal pairs 144, 146, 148, 150, 152, 154, 156, 158 are surrounded on both sides by ground terminals 32. A distance 300 between adjacent central portions 168 of the signal terminals 30 in each signal pair 144, 146, 148, 150, 152, 154, 156, 158 is greater than a distance 302 between adjacent front portions 166 and between adjacent rear portions 170. A distance 304 between the central portion 168 of each signal terminal 30 and the adjacent ground terminal 32 is greater than a distance 306 between the front portion 166 and the adjacent ground terminal 32, and greater than a distance between the rear portion 170 and the adjacent ground terminal 32. Thus, the spacing between the signal terminals 30 that form the signal pair 144, 146, 148, 150, 152, 154, 156, 158 varies so as to provide a desired amount of preferential coupling. Due to the change in dielectric constants, it has been determined that it is beneficial to change the width of the terminals 32 from width W1 in a free portion (that is not seated within the frame 26, 42) to width W2 in the frame 26, 42 (assuming that the thickness is not substantially changed). Thus, the signal terminals 30 provide relatively constant widths W1, W3 and spacing (shown by distances 302) to make mating of the connector 20 with other connectors (not shown) straightforward, while the signal pair spacing is adjusted to provide the desirable electrical performance. A further discussion of preferential coupling is disclosed in pending U.S. application Ser. No. 13/578,839, filed Oct. 23, 2012.

As can be appreciated, the terminals 30 supported by the frames 26, 42 are at a first pitch at the front and rear portions 166, 170 and have a second pitch in the central portion 168. As can be further appreciated, the terminals have free portions at the front and rear portions 166, 170 and a frame portion at central portion 168, the central portion 168 residing in the frames 26, 42. To account for the change in dielectric constant caused by the use of the frames 26, 42, the signal terminals 30 can have one pitch between the front and rear portions 166, 170 and another pitch at central portions 168. In any event, as can be appreciated from FIG. 16, the distance between signal terminals 30 that form the signal pair 144, 146, 148, 150, 152, 154, 156, 158 can increase at the central portions 168 compared to the distance between the same signal terminals in at the front and rear portions 166, 170.

The disclosure provided herein describes features in terms of preferred and exemplary embodiments thereof. Numerous other embodiments, modifications and variations within the scope and spirit of the appended claims will occur to persons of ordinary skill in the art from a review of this disclosure.

What is claimed is:

1. A connector, comprising:

a housing with a front face and a rear face and a mounting face, the front and rear faces being on opposing sides of the housing and the mounting face configured to mount the housing on a circuit board, the front face having a first card slot and the rear face having a second card slot;

a first row of terminals supported by the housing, the first row of terminals including a first set of terminals that have first contacts and second contacts, the first contacts positioned in the first card slot and the second contacts positioned in the second card slot, and the first row of terminals further including a second set of terminals having third contacts in the first card slot and tails that extend to the mounting face, the tails configured to be attached to a circuit board.

2. The connector of claim 1, further comprising a second row of terminals supported by the housing, the second row of terminals including a third set of terminals that have fourth contacts and fifth contacts, the fourth contacts positioned in the first card slot and the fifth contacts positioned in the second card slot, and the second row of terminals further including a fourth set of terminals having a sixth contacts in the card slot and tails that extend to the mounting face, the tails configured to be attached to a circuit board.

3. The connector of claim 2, wherein the first and second rows of terminals are T-shaped.

4. The connector of claim 1, wherein the rear face includes a third card slot, wherein the first row of terminals includes a third set of terminals that have fourth contacts and fifth contacts, the fourth contacts positioned in the first card slot and the fifth contacts positioned in the third card slot.

5. The connector of claim 1, wherein the first set of terminals include ground terminals that extend from the first card slot to the second card slot and the ground terminals are commoned.

6. The connector of claim 2, wherein the first set of terminals include ground terminals that extend from the first card slot to the second card slot and the ground terminals are commoned.

7. The connector of claim 4, wherein the first set of terminals include ground terminals that extend from the first card slot to the second card slot and the ground terminals are commoned.

* * * * *